US005536112A

United States Patent [19]

Oertel, II

[11] Patent Number: 5,536,112

[45] Date of Patent: Jul. 16, 1996

[54] BREAKWATER GENERATING APPARATUS AND PROCESS FOR CONTROLLING COASTAL EROSION

[76] Inventor: George F. Oertel, II, 53 Huxley Pl., Newport News, Va. 23606

[21] Appl. No.: 404,913

[22] Filed: Mar. 16, 1995

[51] Int. Cl.[6] ..... E02B 3/06

[52] U.S. Cl. ..... 405/21; 52/604; 405/31

[58] Field of Search ..... 405/21, 25, 31, 405/32, 35, 29, 30; 52/604, 606, 607

[56] References Cited

U.S. PATENT DOCUMENTS

| | | | |
|---|---|---|---|
| 1,753,776 | 4/1930 | De Vilbiss | 52/608 |
| 3,875,750 | 4/1975 | Cambell | 405/33 |
| 4,407,608 | 10/1983 | Hubbard | 405/31 |
| 4,498,805 | 2/1985 | Weir | 405/31 |
| 4,711,598 | 12/1987 | Schaaf et al. | 405/30 |
| 4,776,725 | 10/1988 | Brade | 405/31 |
| 4,801,221 | 1/1989 | Capron | 405/34 |
| 4,896,996 | 1/1990 | Mouton | 405/21 |
| 5,011,328 | 4/1991 | Atkinson et al. | 405/21 |
| 5,120,156 | 6/1992 | Rauch | 405/25 |
| 5,129,756 | 7/1992 | Wheeler | 405/23 |
| 5,238,326 | 8/1993 | Creter | 405/25 |

*Primary Examiner*—William P. Neuder
*Attorney, Agent, or Firm*—Wallace J. Nelson

[57] ABSTRACT

A plurality of individual modules including individual support platforms for cylindrical hollow core risers are installed in side-by-side interlocked relationship to construct a semi-permeable barrier that is oriented in load distributing relationship approximately parallel to the shoreline. This semi-permeable barrier forms a hollow core and high profile breakwater that is intended to dissipate the energy of incoming waves before they reach the shoreline. Gaps between modules, and between high profile sections of the breakwater allow free flow of water between the landward and seaward sides of the barrier to prevent elevated water levels behind the barrier. An upper riser section of each module is partially submerged at high tide and emerged at low tide. The seaward facing lower section of the module has an inclined ramp that absorbs reflected wave energy and inhibits toe scour. Precast wafers of concrete can be added or removed from the modules as required for ballast.

20 Claims, 8 Drawing Sheets

BREAKWATER GENERATING APPARATUS AND PROCESS FOR CONTROLLING COASTAL EROSION

FIELD OF THE INVENTION

The invention relates to coastal erosion control in general and relates specifically to modular devices and the process of employing interconnected multiples of these devices to control coastal erosion.

BACKGROUND OF THE INVENTION

Beaches experience erosion in response to energy resulting from waves that impinge on the shoreline. A variety of breakwater types have been previously used with varying degrees of success, to inhibit the deterioration of beaches. Most of the previous inventions in this area have been constructed in areas having relatively low tidal ranges. In regions where tidal ranges exceed one meter, the stage of the tide also plays an important role on the vertical distribution of wave energy on the beach face. The present invention employs a high-profile module designed specifically for regions with tidal ranges between one to three meters, but it is also suitable for deep deployment in low-tidal range regions.

In regions of relatively high tidal range, low-profile modules are often ineffective. If the devices are placed on the upper part of the beachface to shield the shore from waves at high water, the devices are left high-and-dry as the tide falls to low water level. If they are placed to intercept waves at low water, then they are too deep at high water to effectively shield the beach from incoming waves.

Since beaches are made of granular material, they are subject to change in direct response to the ability of the wind, waves and currents to transport the sediment. The process of erosion is an accounting problem related to sand transport by wind, waves and currents. Simply stated, when more beach material leaves a section of shore than it receives, the volume loss is described as erosion. When more beach material enters a section of shore than it loses, the volume gain is described as accretion. Since the capacity of a wave to transport sand is related to its size, then variations in wave size similarly relate to variations in the transport capacities of wave fields. Large waves, or strong wave-driven currents, have a greater capacity to transport beach material than small waves or weak wave-driven currents. By obstructing a portion of an incoming wave field, the capacity of the wave field to transport sediment is also diminished. The resultant is that less sand is removed from the beach than would be expected from the previously unobstructed waves. This is the main principal in the use of breakwaters for inhibiting erosion.

Some of the prior art has been directed toward trapping the littoral transport system. Others have been located further offshore to intercept wave energy before it reaches the shore. Much of the offshore systems have been composed of relatively small modules that are placed side-by-side and stacked to produce a submerged barrier parallel to the shoreline. Scour at the base of individual modules often causes them to shift, rotate forward, and/or sink into the seafloor. Stacks of multiple modules are massive, tend to sink into the seafloor rapidly and are difficult to remove or re-orient for breakwater modification or upgrade.

The cited patents represent an evolution of concepts that have provided partial solutions to some coastal areas of the world. Although each of these systems has provided valuable insights to the art, none have proven to be universally successful. For example, De Vilbiss (U.S. Pat. No. 1,753,776) describes a method of making a casing for making "filled concrete blocks". The concrete blocks may be used for revetment or levee work on river banks and can be filled with sand and gravel.

Campbell (U.S. Pat. No. 3,875,750) describes a modular unit for preventing and reversing erosion of waterfront land. The modules are elongated concrete blocks which are roughly triangular in cross-section, and have five peaks and four depressions. The central peak is the topmost, and two peaks are symmetrically located on either side of the central peak at progressively lower elevations.

Hubbard (U.S. Pat. No. 4,407,608) describes a modular structure for effecting deposits of fluid entrained alluvium. It is roughly triangular in cross-section, and has a smooth sloping rear face, and a concave surface along the front.

Weir (U.S. Pat. No. 4,498,805) describes a concrete breakwater module for shoreline protection. It is roughly triangular in cross-section, and has a vertical rear face, a large upwardly concave trough, and a sloping front wall. The rear wall is substantially higher than the front wall and the top and front walls have a variety of holes and passageways for redirection flow.

Schaaf et al (U.S. Pat. No. 4,722,598) describe a concrete module partially submerged to dissipate the energy of waves. The module is roughly triangular in cross-section, and has sloping seaward and rear faces. Openings on the front face lead to a series of passages that terminate in upwardly-directed openings on the rear face.

Brade (U.S. Pat. No. 4,776,725) describes an erosion control apparatus comprised of a plurality of interconnected members. Each of the members includes the equi-angularly disposed planar panels integrally coupled to a hub. One panel is vertically disposed and the other two rest on the seafloor.

Capron (U.S. Pat. No. 4,801,221) describes an "Ocean-wheel Breakwater" which transfers lateral loads from the sea surface to the seafloor. The wall is composed of modular concrete cylinders held together by a tension spoke.

Mouton et al (U.S. Pat. No. 4,896,996) describes a series of low-profile beach cones for trapping sand on the beach-face. Rows of beach cones are placed along the waters edge at low tide to eliminate the damaging effects of "undertow".

Atkinson et al (U.S. Pat. No. 5,011,328) describes a permeable breakwater constructed of precast concrete beams and plastic piping. The structure is roughly triangular in cross-section with an upward projecting (vertical) permeable wave wall.

Rauch (U.S. Pat. No. 5,120,156) describes a submerged breakwater comprised of a plurality of modules. The modules are roughly triangular in shape. The beachward and seaward faces are gently concave upward. The top of the modules have a short vertical wall with three open channels between the seaward and landward faces. The ends of the modules have interlocking members which allow construction along a continuous axial line.

Wheeler (U.S. Pat. No. 5,129,756) describes an apparatus for coastal erosion control using a massive seablock system. The blocks are large rectangular blocks that could be filled with sand, mud, shell or concrete rip rap. Each block has a massive concrete lid. The blocks are arranged along the shoreline in desired geometric patterns along coastal areas subject to erosion.

Creter (U.S. Pat. No. 5,238,326) discloses a concrete module partially submerged to dissipate the energy of waves. The module is roughly triangular in cross-section, and has sloping seaward and rear faces. The tops of the seaward and landward faces have transversely disposed concave cutouts that extend horizontally across the faces.

SUMMARY OF THE INVENTION

An object of the present invention is to provide a breakwater system that distributes the wave forces applied to one section of the breakwater along the entire length of the structure.

Another object of the present invention is to provide a modular breakwater system to shield a reach of shoreline from the destructive energy of incoming waves.

Another object of the present invention is to provide an interlocking breakwater constructed of a plurality of relatively portable modules.

A further object of the present invention is to provide a relatively light weight structure for ease of handling during placement, but that can be made heavier when required for resistance to wave forces.

An additional object of the present invention is to provide a variable weight breakwater module system to facilitate adaptation, re-orientation, relocation or removal of the modules when required, and wherein the increase and decrease weight is accomplished without jeopardizing the integrity of the system structure.

Another object of the present invention is to provide a breakwater system that is adaptable for dissipating wave energy in response to changing water levels produced by the rising and falling tide.

A still further object of the present invention is a breakwater system that is capable of causing the waves to break prematurely, will capture a portion of incoming wave crests, and convert the horizontal momentum of the wave crest to a downward moment.

Another object of the present invention is to provide a breakwater system that, when exposed in relatively deep water, can reflect the energy of incoming waves back in a seaward direction and, when in relatively shallow water, can dissipate the energy of incoming waves by redirecting the wave bore and swash in a seaward direction. Another object of the present invention is a process of radially distributing reflected wave energy, thus diminishing the focussing effect of reflected wave rays in any given direction.

According to the present invention, the foregoing and additional objects are attained by providing a cylindrical modular caisson made of reinforced concrete, mounted on a platform for stability and support and positioned in side-by-side relationship with like modules to form a hollow core and high profile breakwater. The platform sections interlock with adjacent platforms to distribute loads. An upper riser section of each module is partially submerged at high tide and emerged at low tide. The seaward facing lower section of each module has an inclined ramp that absorbs reflected wave energy and inhibits tow scour. Precast wafers of concrete can be added or removed from the caisson modules as required for ballast.

BRIEF DESCRIPTION OF THE DRAWINGS

A more complete appreciation of the invention and many of the attendant advantages thereof will be readily apparent as the same becomes better understood with reference to the following detailed description when considered in connection with the accompanying drawings wherein.

Figure 2:
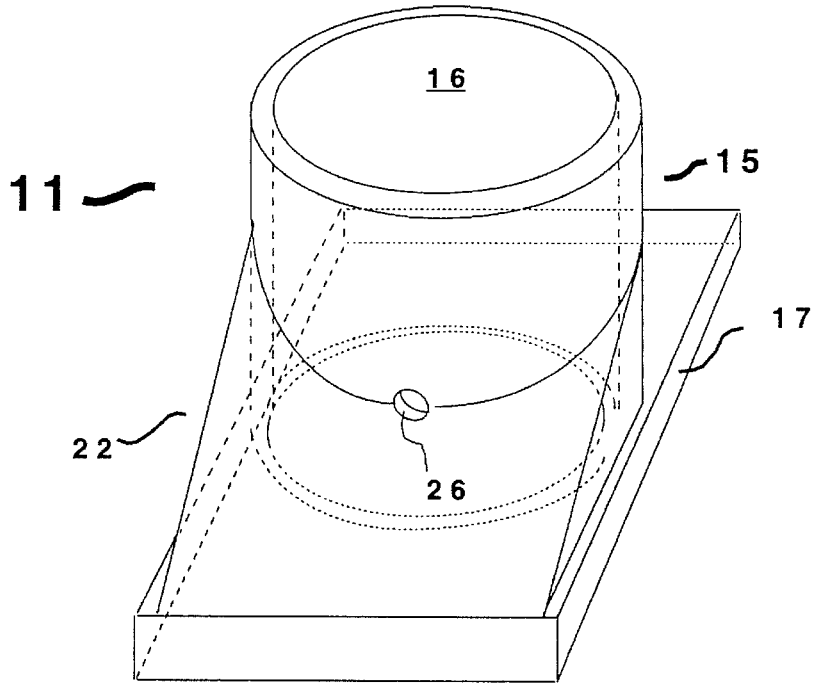
FIG. 2 is a part schematic, perspective view of an individual breakwater module, with parts omitted, according to the present invention.
Figure 3:
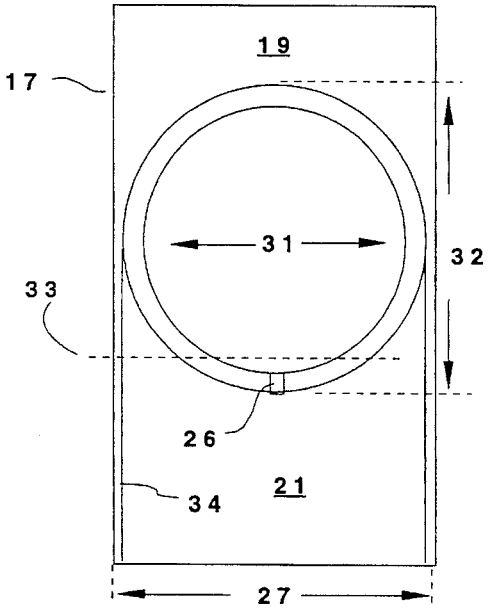
Figure 4:
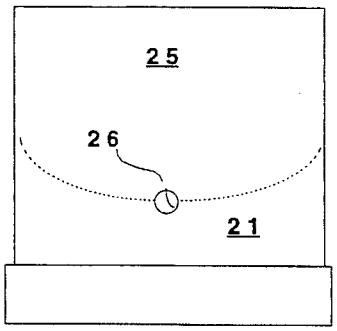
Figure 5:
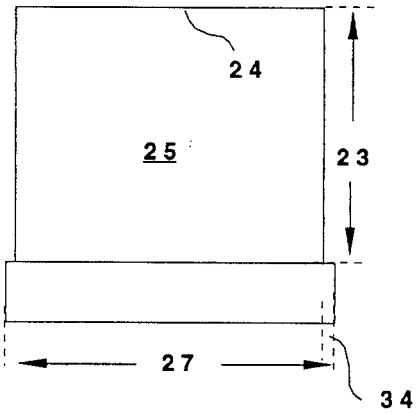
Figure 6:
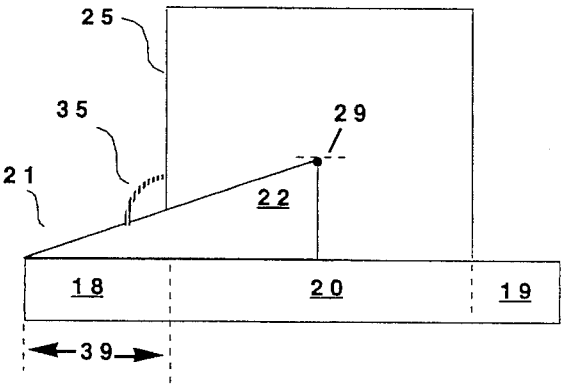
Figure 7:
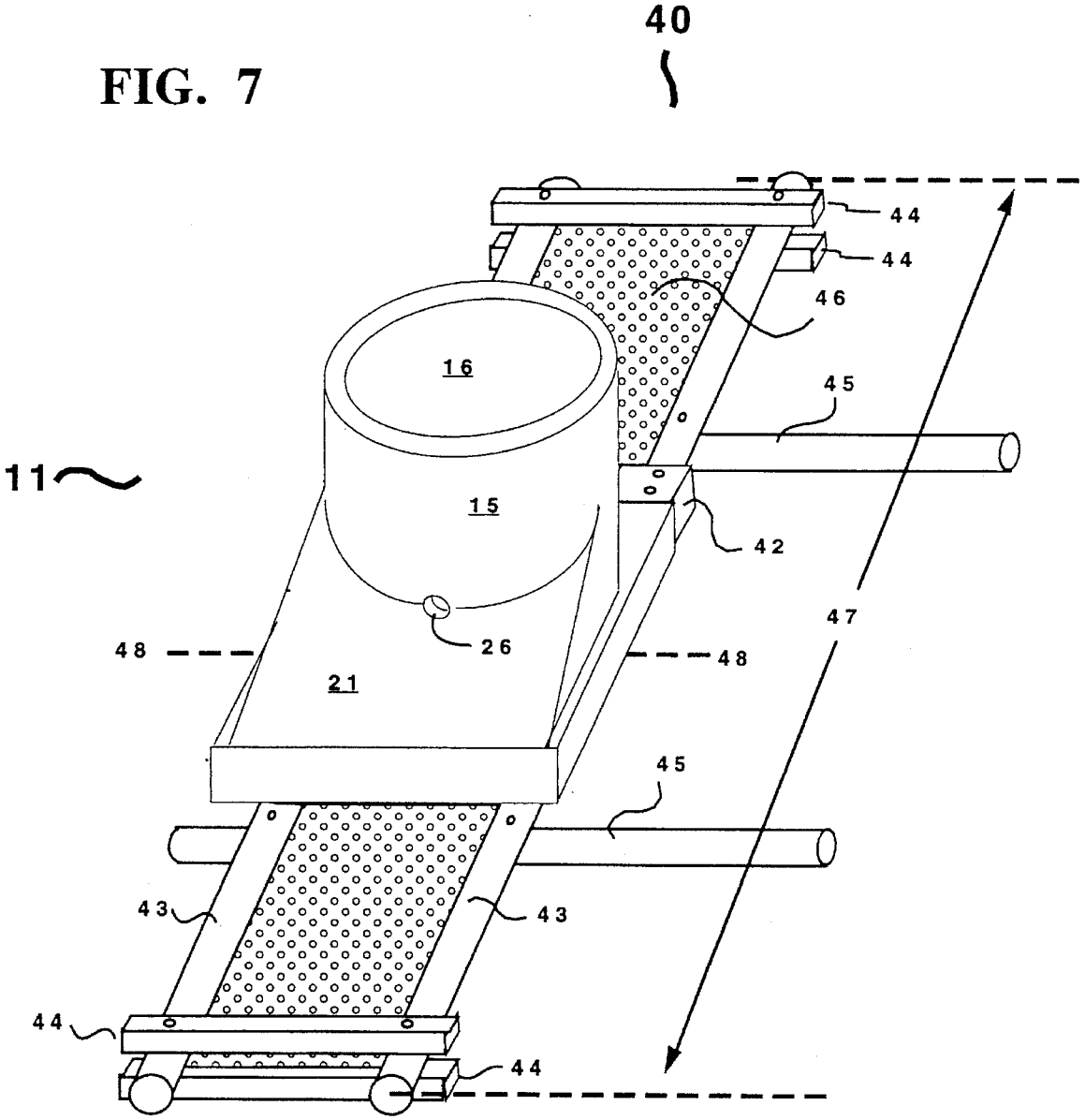
Figure 8:
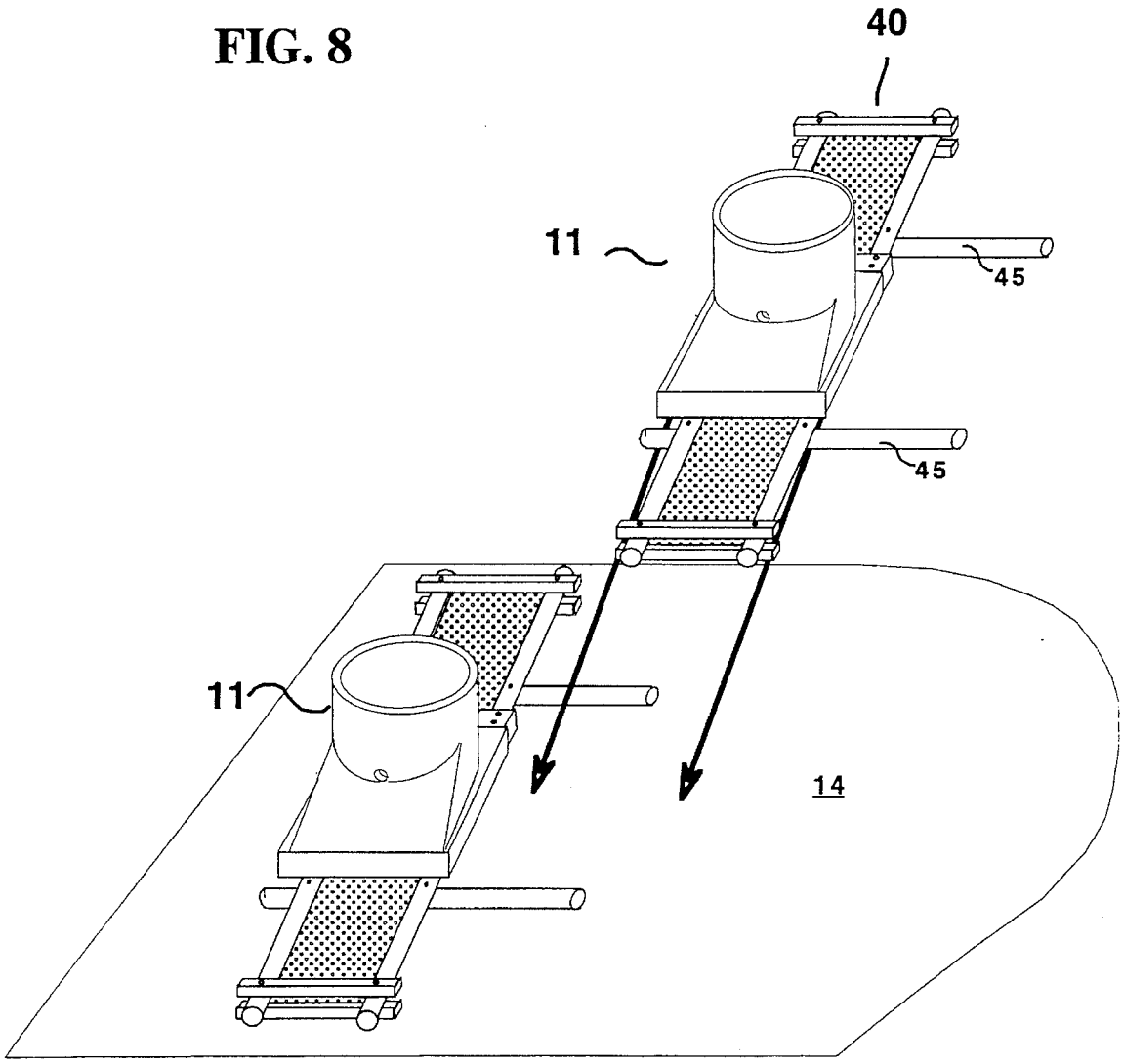
Figure 9:
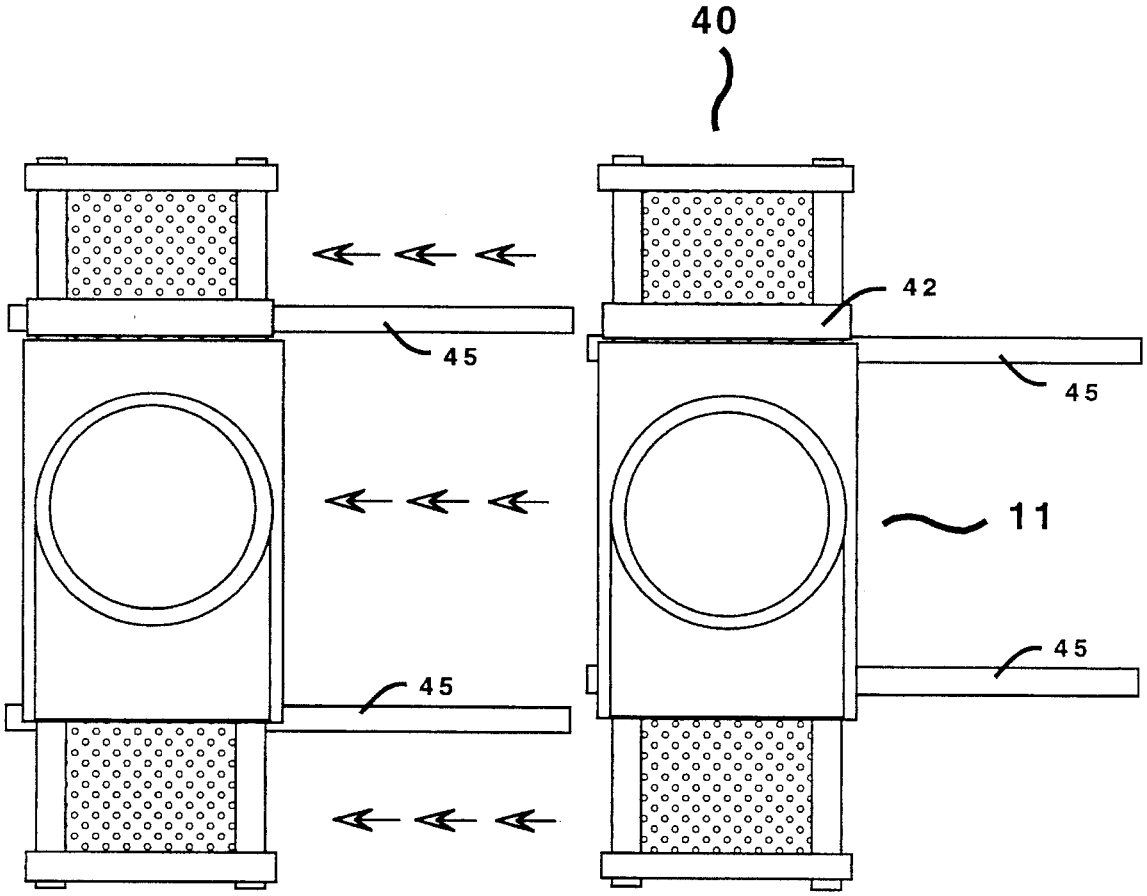
Figure 10:
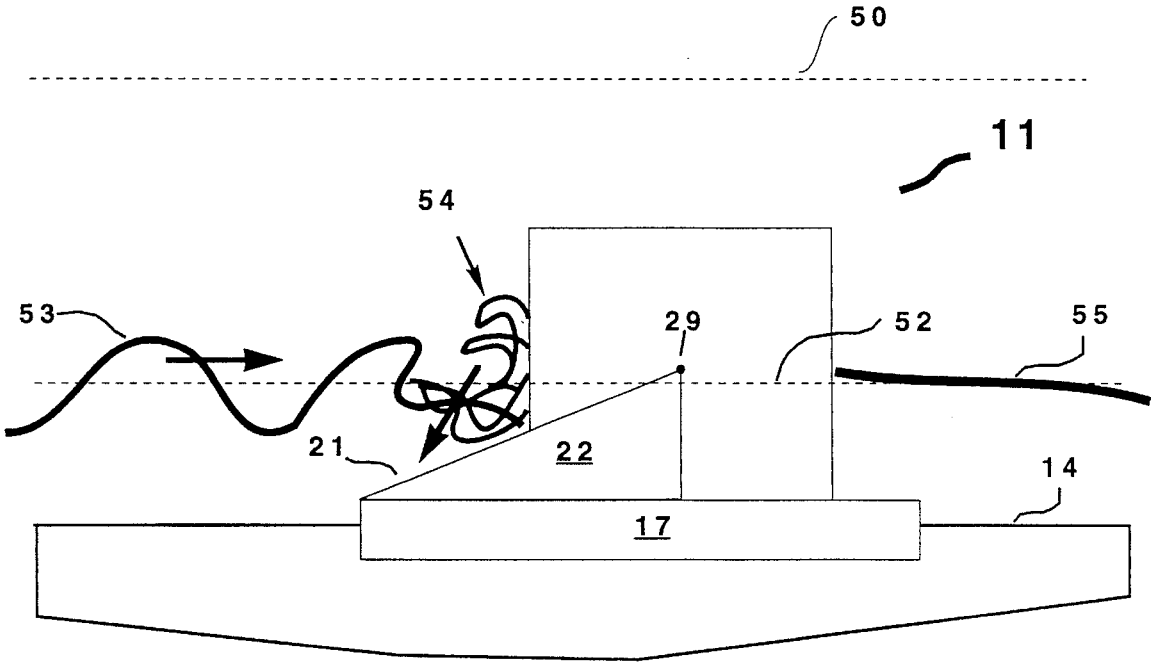
Figure 11:
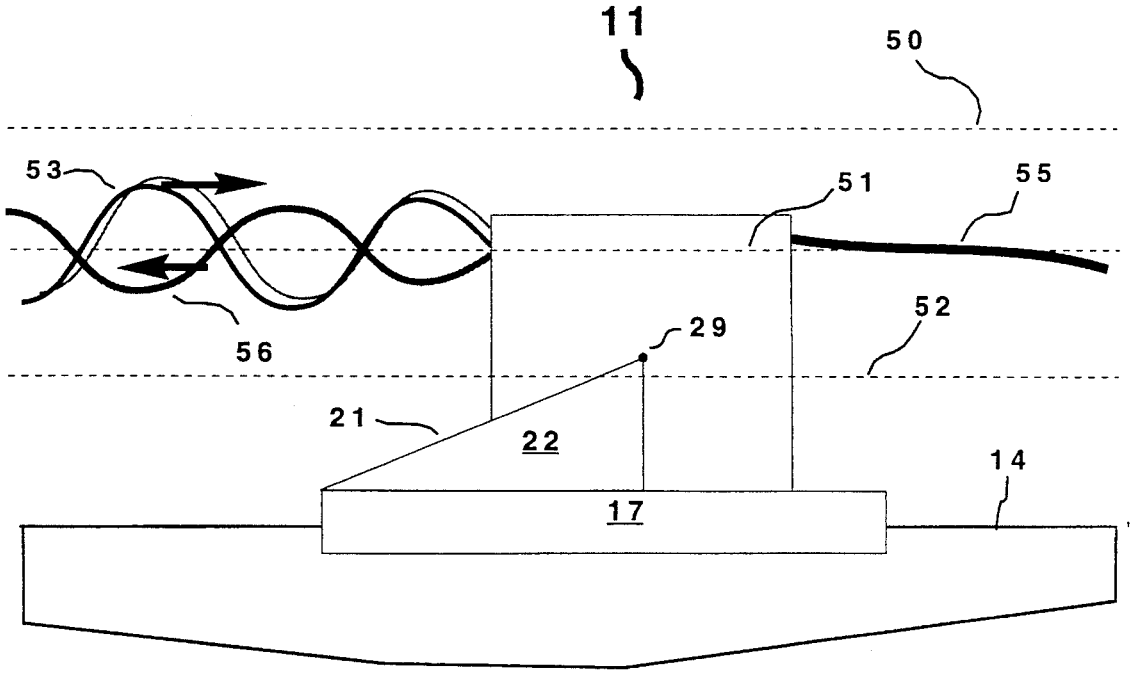
Figure 12:
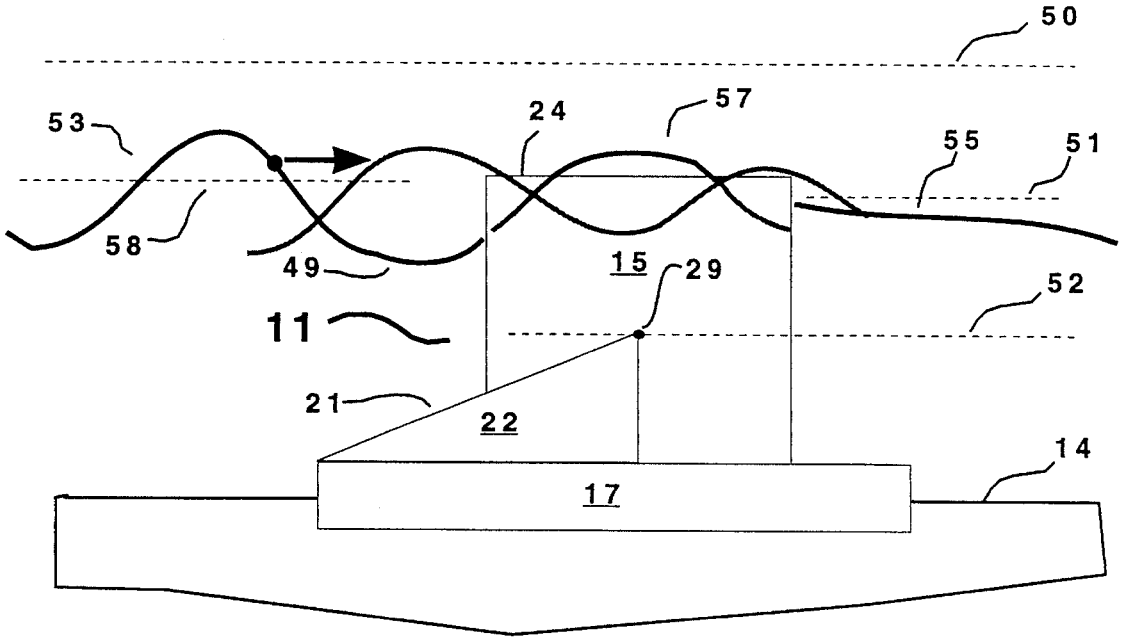
Figure 13:
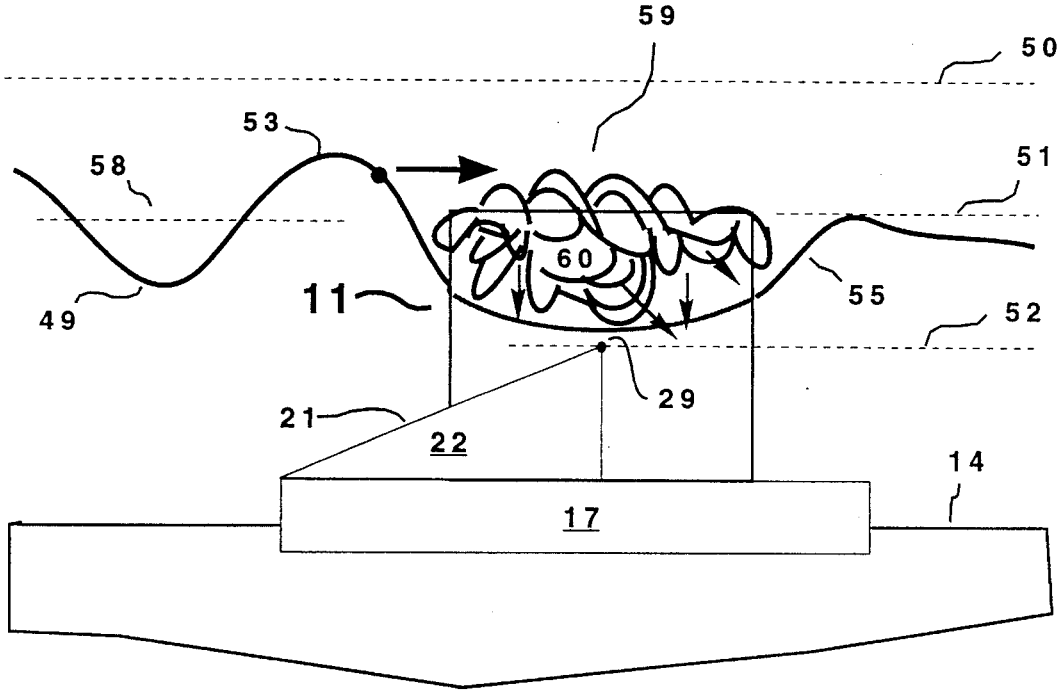

FIG. **2*a*** is a schematic view of a ballast wafer employed in an individual module of the present invention;

FIG. 3 is a top view of the individual breakwater module shown in FIG. 2;

FIG. 4 is a schematic front view of the individual breakwater module shown in FIG. 2;

FIG. 5 is a schematic back view of the individual breakwater module shown in FIG. 2;

FIG. 6 is a schematic side view of the individual breakwater module shown in FIG. 2;

FIG. 7 is a schematic perspective view of an individual breakwater module mounted on its support platform;

FIG. 8 is a schematic perspective view of a first module and support platform as shown in FIG. 7 placed in position on the seafloor, and a second module and support platform in position to be lowered and slid into place on the seafloor;

FIG. 9 is a schematic top view of two module and support platform units that are aligned so that the support/locking rails thereon can be keyed together;

FIG. 10 is schematic, part sectional, view of an emergent module according to the present invention and showing wave-energy dissipation on the module ramp during moderate wave conditions and at low-water levels;

FIG. 11 is a schematic, part sectional, view of a partially emergent module of the present invention and showing wave-energy dissipation on an arched riser face during moderate wave conditions and at intermediate-water levels;

FIG. 12 is a schematic, part sectional, view of a partially emergent module of the present invention showing wave-energy dissipation during moderate wave conditions when the still water level of incoming wave swell is approximately equivalent to the top of the riser, and the crest of a wave is trapped over the hollow core of the riser; and FIG. 13 is a schematic, part sectional, view of a partially emergent module showing wave-energy dissipation during moderate wave conditions and when the still water level of incoming wave swell is approximately equivalent to the top of the riser, and the trough of a wave is over the hollow core of the riser wherein trapped crest water of the previous wave spills over the lip of the riser.

DETAILED DESCRIPTION

Figure 1:
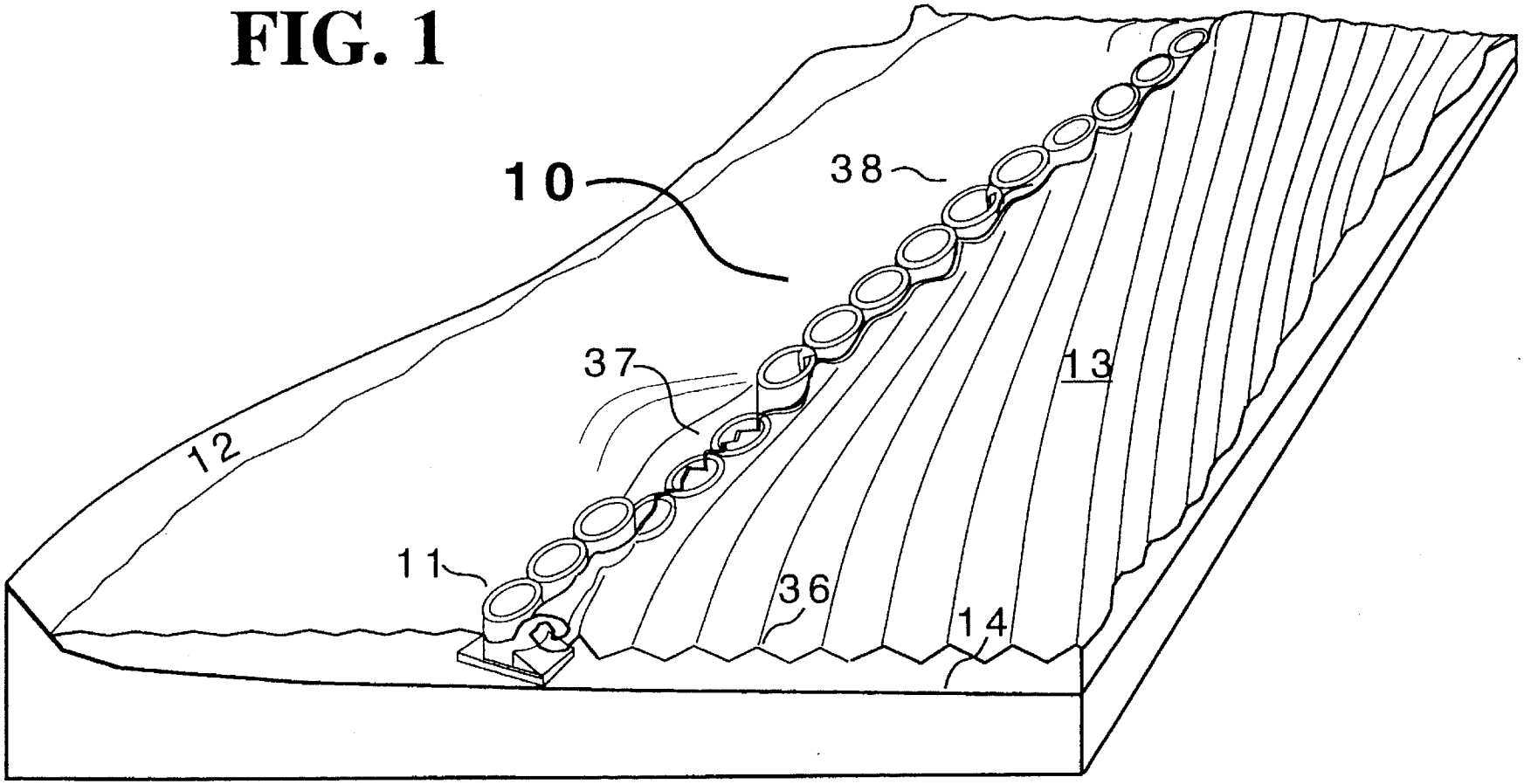
FIG. 1 is a part schematic, perspective view of a breakwater employing a plurality of modular units according to the present invention with the interconnected modules being disposed in side-by-side relationship and roughly parallel to, and spaced from, the shoreline.

Referring now to the drawings and more particularly to FIG. 1 there is shown a hollow core breakwater assembly 10 disposed essentially parallel to a sea shore area 12 within sea 13 having wave crests 36. Breakwater assembly 10 is formed of a plurality of individual hollow core modules 11 interconnected together and disposed on sea floor 14, as will be further explained hereinafter. Although this specific embodiment shows breakwater assembly 10 as being essentially parallel to sea shore 12, it can be arranged in a variety of geometric configurations, as so desired, and as dictated by the bathymetry and the shore line to be protected. In the illustrated embodiment, hollow-core breakwater 10 includes a long section of high-profile modules 38 separated by a short section of low-profile modules 37. In a particular embodiment, the hollow core of modules 11 forming the high profile breakwater section 38 are approximately eight feet high with an eight foot diameter riser 15 (FIG. 2) disposed on a base approximately eight foot, four inches wide, by twelve foot long and weigh approximately eighteen tons each. The modules 11 forming the low profile breakwater section 37 are approximately four feet high with the remaining dimensions being the same as those for the high profile breakwater section 38.

Referring now more particularly to FIGS. 2–6, the details of one module 11 employed to form the breakwater 10 will now be described. As illustrated, module 11 includes a cylindrical vertical riser 15, having a hollow core 16, and is secured to a rectangular flat base 17. The base 17 of module 11 is a rectangular pad of reinforced concrete which rests on an interlocking support platform 40 (FIG. 7) which, in turn, rests on the seafloor 14, as will be further explained hereinafter.

Hollow-core module 11 and support platform module 40 are not constructed as a unit, but are held together by the force or weight of the hollow-core module 11 on the support platform module 40. On surfaces with suitable coefficients of sliding friction and bed support characteristics, hollow-core modules 11 may be used independent of support platform modules 40.

Figure 2A:
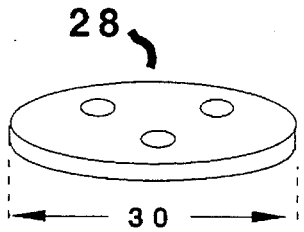

The interior and exterior wall 25 of riser 15 is vertical and the top 24 thereof is open. The wall of the cylindrical riser 15 is provided with at least one through opening 26. The lower section of the seaward face of module 11 is a prism 22 formed of reinforced concrete. Prism 22 may be cast onto ramp base section 18 during the casting of base 17, or during a third casting. The ramp surface 21 of prism 22 slopes down to the seafloor 14. A plurality of reinforced concrete wafers, one of which is shown in FIG. 2*a* and designated by reference numeral 28, and having diameters 30 that are slightly smaller than the inside diameter 31 of riser 15, are provided to serve as ballast for module 11, when needed.

FIG. 3 illustrates the rectangular shape of base 17 and shows that base 17 is slightly wider than the outside diameter 32 of riser 15. When placed side-by-side, the side lip base 34 of adjacent modules are butted against each other thus leaving a vertical gap between side walls 15 of adjacent risers 25. In a specific embodiment this vertical gap is approximately four inches.

The hole or through opening 26 in riser 15 is disposed at the top of the sloping ramp surface 21 of prism 22 and on the seaward face of riser 15. In a preferred embodiment, through opening 26 has a diameter in the range of nine to twelve inches. The purpose of hole 26 is to allow water levels on the inside and outside of riser 15 to be equivalent.

FIGS. 4 and 5, respectively, illustrate the front and rear views of the module 11. Referring more particularly to FIG. 6, the base 20 of the riser section 15 is closed or sealed by base 17. The base 17 is cast onto the bottom of a precast riser 15. In the preferred embodiment, the base is approximately one foot thick and is cast as a single rectangular wafer. For the purpose of illustrating different functions, base 17 has three sections. Ramp base section is beneath the sloping ramp surface 21 of reinforced concrete prism 22. The section of base 17 beneath the riser base 20 and the lip 19 on the landward side of the module is a reinforced concrete pad rectangular in side section.

On the seaward side of the module, prism 22 is triangular in side section. The highest part of the sloping ramp 21 is on the sides of the outer wall 25 of riser 15, as designated by reference numeral 29. In the preferred embodiment, the point designated by reference numeral 29 is located approximately eight feet from the front and lowest part of inclined ramp 21 and approximately four feet above the bottom of base section 20. The resulting oblique angle 35 formed between the riser 15 and the sloping ramp 21 is within the range of 110–130 degrees and is, preferably, about 116 degrees. Prism 22 is thickest against the riser 15 and slopes away from the riser 15 to form angle 35 between the wall of riser 25 and the sloping ramp surface 21. The length 39 of the prism base section 18 is essentially one-half the diameter 32 of riser 15, or approximately four feet. The height of risers 15 may vary with a short riser being as short as the top 29 of the ramp. A typical riser height 23 (FIG. 5) is equal to about the outside diameter 32 of the module riser.

FIG. 7 illustrates a perspective view of a module 11 including its support platform unit 40. Platform unit 40 includes a pair of spaced support rails 43 held in place by a module locking rail 42 disposed on the landward side of the module. The center of gravity 33 of module 11 is placed on a centerline 48 of the platform 40 and is equal to approximately one-half the length 47 of the platform 40. The length of platform is determined by the stress loading characteristics of the underlying substrate 14. In one specific embodiment of a support platform 40 for high profile modules, module support rails 43 are constructed of treated timber pile approximately thirty feet long and one foot in diameter. The support rails 43 are spaced approximately six feet apart and bolted in position through upper and lower cross ties 44. Cross ties 44 are formed of reinforced concrete cast to seven foot lengths and are 9×9 inch squares, in section. The module locking rail 42 is also a concrete casting and seven feet long, but it is a 12×12 inch square in section The locking rail 42 prevents the landward shifting of hollow-core module 11 during wave-module interactions. Cross ties 44 are fastened to the top and bottom surfaces of the ends of support rails 43.

A pair of spaced platform support and lateral locking rails 45 are pinned, or bolted, to module support rails 43 adjacent to the respective ends of platform section supporting hollow-core module 11. A suitable filter section 46 is disposed between the portions of module support rails 43 that extend beyond base 17. Filter sections 46 is formed of suitable and conventional fabric filter, or like corrosive resistant material and serve to inhibit the sinking rate of the unit into soft sediment.

FIGS. 8 and 9 schematically illustrate the side-by-side placement of a pair of modules 11 onto lateral locking rails 45 to form a continuous interlocking platform for breakwater modules 11. Locking rails 45 in adjacent platforms are offset and slide together so that the rails can inhibit vertical and horizontal movement of platform units 40.

Module support rails 43 rest on the lateral locking rails 45 of adjacent support platforms 40. This laterally distributes the weight of a hollow-core module 11 over several support platforms 40. The purpose of this feature is to prevent differential settling of one support platform 40 below adjacent support platforms 40 to help maintain the linear integrity of the crest elevation of the entire hollow-core breakwater 10. The spacing between lateral locking rails 45 at adjacent support platforms 40 are purposely different for functional reasons. Lateral locking rails 45 of one support platform unit 40 are slid inside or outside of the lateral locking rails of the adjacent support platform 40. The contiguous position of locking rails 45 of adjacent platforms 40 provides horizontal leverage to inhibit twisting or shifting of any one support platform 40 independent of adjacent platform units 40. This maintains the linear horizontal integrity of the entire hollow-core breakwater 10. Lateral locking rails 45 are also formed of suitable treated timber pile and are in the range of sixteen to twenty feet in length.

Referring now to FIG. 10, the process of wave energy dissipation at low tide is illustrated. The modules 11 are placed at a depth on the seafloor 14 so that the upper most part 29 of the inclined ramp surface 21 on the sides of the module are approximately at the still water level 52 at low tide. Dotted line 50 indicates still water level at high tide. Incoming wave crests 53 steepen over at the module produces a much flatter water surface 55 on the landward side of breakwater 10.

The process of wave energy dissipation at mid tide is illustrated in FIG. 11. The still water level at mid tide is denoted by dotted line 51. Incoming wave crests 53 strike the riser 15 section of module 11 and are reflected laterally and back in a seaward direction as denoted by reference numeral 56. The reflection of energy away from the seaward side of the module produces a much flatter water surface 55 on the landward side of the breakwater.

Referring now more particularly to FIGS. 12 and 13, the process of wave energy dissipation at moderately high tides is illustrated. When the still water level of the incoming wave 58 is near the top 24 of riser 15 a portion of incoming wave crest 59 is trapped in the hollow core 16 of riser 15. As the wave form progresses so that wave troughs 49 enter the hollow core 16, the previously trapped crest 59 spills over the lip of riser 15 as indicated by reference numeral 60. The spilling 60 of water from wave crests 53 reduces the height of waves that cross the hollow core breakwater 10 and produces a flatter water surface 55 on the landward side of breakwater 10.

The operation of the invention is believed apparent from the foregoing description and is as generally shown in FIGS. 1 and 10–13. The operation of the breakwater 10 and modules 11 is effected by the relative elevation of the water surface with respect to the module 11. Wave energy dissipation is accomplished in a variety of ways related to different water levels. Generally, waves are modified as a portion of the incoming waves strike the seaward side of the breakwater. Overturning and sliding of modules 11 by wave forces is restricted by both structural weight and downward directed wave pressure on the wave ramp. Additional ballast weight can be added to the structure by placing removable concrete wafers 28 on the base 20 of the riser 15. The reinforced concrete prism 22 on the seaward side of the breakwater modules also inhibits overturning by moving the center of gravity further forward of the pivot point. The force on incoming waves is also distributed laterally to adjacent portions of the breakwater 10 because of the interlocking nature of support platform units 40.

At high tide, incoming waves 36 (FIG. 1) from sea 13 pass over the breakwater 10, and the submerged portion of the waves interact with the submerged structure. Incoming waves 36 are modified as they encounter the apparent reduction in water depth created by the crests of the hollow core breakwater. The interaction is similar to those at natural reefs or submerged breakwaters of artificial origin. At depths equal to about one-half the wave length the orbital motion of the water is interrupted by the breakwater structure. Friction drag of the lower part of the wave with the breakwater causes the wave crest to proceed ahead of the wave trough. As a result, wave orbits tend to become more elliptical. Wave energy is lost from the submerged portions of waves and wave crests get steeper and closer together. After the altered wave crosses the submerged obstruction and enters deeper water, the wave crests flatten and spread apart. If the wave heights are such that they are equal to, or greater than, about three-fourths of the water depth between the top of the breakwater and the wave, then the waves break.

As the tide falls, the nature of the interaction with the breakwater changes. If wave heights are such that the top of the breakwater becomes exposed as the wave trough passes over the breakwater, then a portion of the water in the wave crest is captured in the hollow core part of the breakwater (FIGS. 12, 13). As water level falls with the approaching trough, the captured crest water drains over the rim of the riser.

At intermediate water levels, incoming waves reflect off of the seaward wall of riser 15. The cylindrical arch walls of the riser transmit wave forces laterally along the rim. Wave reflection along the arch wall causes reflected wave rays to be re-oriented in a radially dispersed pattern away from the surface. This is a more effective way of redistributing energy than reflection off a plan-faced wall. Portions of reflected waves that are directed downward are intercepted by the wave ramp before contacting the seafloor. This reduces the potential for scour by reflected waves.

At low water levels when riser 15 is emerged, waves slide up the face of the wave ramp and break on the seaward face of the riser. Backwash from broken waves slide back down the hardened surface of the wave ramp.

It is thus seen that the present invention has a high profile shape that is able to interrupt the various elements of incoming waves as the water level rises and falls with the tide. The use of large reinforced concrete pipes and precast bases permit the modules to be fabricated at a pipe casting yard and then transported to the site of use; any eroding shores where erosion control is needed. The relative light weight of the modules permits deployment from the beach via heavy duty front end loaders or by sea by use of crane barges.

A plurality of the modules are arranged side-by-side and placed on the seafloor to form an intertidal breakwater with the depth of placement below the mean low water elevation being equal to the breaker height of typical seasonal storm waves. The modules are locked together by timber-mat platforms that also support and distribute the weight of the modules over the seafloor.

The modules are placed at a sufficient distance apart so small marine wildlife may migrate around the "reef-like" structure. The gaps between the modules, and at low profile sections 37 of the breakwater, allow free flow of water between the landward and seaward side of the breakwater barrier.

Although the invention has been described relative to specific embodiments thereof, it is not so limited and there are numerous modifications and variations thereof that will be readily apparent to those skilled in the art in the light of the above teachings. For example, hollow risers 15 are described as being cylindrical but they could perform just as well if formed of oval or elliptical cross-sectional areas.

It is therefore to be understood that the invention may be practiced other than as specifically described herein.

What is claimed as new and desired to be secured by Letters Patent of the United States is:

1. A breakwater assembly for controlling coastal erosion and formed from a plurality of modular units, each module unit comprising:

a substantially rectangular platform;

said substantially rectangular platform having a seaward side, a landward side and a pair of parallel sides adapted for interconnection with additional platforms;

a hollow core cylindrical riser having a first end secured in sealed relationship to said platform, and a second open end vertically spaced from said platform;

said hollow core cylindrical riser having a circumference that is spaced from each of said seaward, said landward, and said pair of parallel sides of said rectangular platform;

an inclined ramp formed on said seaward side of said rectangular platform;

said inclined ramp having a first end engaging said hollow core cylindrical riser at a point thereon disposed between said first end secured to said platform and said second open end;

said inclined ramp having a second end extending to and merging with said seaward side of said platform;

at least one through opening formed through said hollow core cylindrical riser; and said at least one through opening formed through said hollow core cylindrical riser being disposed essentially at the point of engagement of said inclined ramp and said hollow core cylindrical riser.

2. The breakwater assembly of claim 1 wherein each said substantially rectangular platform is provided with a pair of elongated spaced support rails extending along, and exceeding, the length of said rectangular platform; a module locking rail connected to said pair of spaced support rails and disposed on the landward side of said platform; and, a pair of cross ties fastened to the top and bottom surfaces of the ends of said support rails.

3. The breakwater assembly of claim 2 including a section of filter fabric disposed in an area defined by said pair of spaced support rails, said rectangular platform and each pair of cross ties on both the seaward and the landward sides of said platform.

4. The breakwater assembly of claim 3 including a pair of spaced lateral locking rails; one member of said pair of spaced lateral locking rails being positioned on the seaward side of said platform and the other member of said pair of lateral locking rails being positioned on the landward side of said platform; each of said lateral locking rails having a first portion thereof extending beneath and pinned to said pair of spaced support rails, and a second portion extending laterally from said platform; said second portion of said lateral locking rails having a length that is at least equal to the width of said platform whereby when two or more modules are placed in side-by-side relationship, the locking rails in adjacent platforms are offset and slide together so that the rails inhibit vertical and horizontal movement of the platform units.

5. The breakwater assembly of claim 1 wherein said plurality of modular units includes both high profile modules and low profile modules and wherein said high profile modules are approximately twice the height of said low profile modules.

6. The breakwater assembly of claim 5 wherein said high profile modules are approximately eight feet high, have an eight foot diameter riser and are disposed on a base approximately eight foot, four inches wide, by twelve foot long and weigh approximately eighteen tons each.

7. The breakwater assembly of claim 1 wherein said module unit is designed for wave energy dissipation at low tide; said inclined ramp having a height substantially equal to the height of the still water level at low tide; whereby, incoming wave crests steepen over said inclined ramp and are reflected laterally and downward by the face of said riser and at least some of the energy of the reflected breaker is directed toward the sloping surface of said ramp to thereby produce a much flatter water surface on the landward side of the breakwater assembly.

8. The breakwater assembly of claim 1 wherein the still water level at mid tides is higher that the height of the still water level at low tides and wave energy dissipation by said module unit at substantially mid tides is accomplished by incoming wave crests striking said riser section and being reflected by said riser section laterally and back in a seaward direction to thereby produce a flatter water surface on the landward side of said breakwater.

9. The breakwater assembly of claim 1 wherein the still water level at moderately high tides is near the top of said riser, and wave energy dissipation by said module unit at moderately high tides is accomplished by trapping a portion of any incoming wave crest in the hollow core of said riser thereby reducing the height of waves that cross said hollow core breakwater and causing a flatter water surface on the landward side of said breakwater.

10. A breakwater assembly for controlling coastal erosion;

said breakwater assembly being formed from a plurality of modules interconnected together and disposed in linear relationship on a seafloor;

said plurality of modular units including both high profile and low profile hollow core modules;

each said hollow core module including a hollow riser member secured to an essentially flat rectangular platform;

said essentially flat rectangular platform of each said hollow core module being disposed in abutting relationship with another essentially flat rectangular platform when said plurality of modules are interconnected together; and each said hollow riser member of each said hollow core module being disposed in spaced relationship with another hollow riser of another hollow core module when said plurality of modules are interconnected together.

11. The breakwater assembly of claim 10 wherein the height of said hollow riser members of said low profile hollow core modules are essentially one-half the height of said hollow riser members of said high profile hollow core modules.

12. The breakwater assembly of claim 10 including reinforced concrete wafers dimensioned to fit within said hollow riser members for adding or removing ballast for said hollow core modules on an as needed basis.

13. The breakwater assembly of claim 10 wherein said essentially flat rectangular platform is provided with a seaward side, a landward side and a pair of parallel sides adapted for interconnection with additional said platforms; each said hollow riser member secured to an essentially flat rectangular platform being provided with a circular diameter and disposed on said essentially flat rectangular platform adjacent the landward side of said platform such that an exposed portion of said rectangular platform is present between said hollow riser and each of said seaward side, said landward side and said pair of parallel sides of said platform.

14. The breakwater assembly of claim 13 including an inclined ramp formed on said seaward side of said rectangular platform; said inclined ramp having a first end abutting said hollow riser member and forming an angular connection therewith in the range of 110–130 degrees.

15. The breakwater assembly of claim 14 wherein said inclined ramp has a second end extending to and merging with said seaward side of said platform.

16. The breakwater assembly of claim 15 including at least one through opening provided within said hollow riser member; said at least one through opening being positioned adjacent the area of abutment of said inclined ramp with said hollow riser member.

17. A method of controlling coastal erosion comprising the steps of:

providing a breakwater assembly formed from a plurality of interconnected modular units wherein each modular unit includes a vertical cylindrical hollow core riser mounted on a platform;

providing vertical spacing between the cylindrical hollow core risers of adjacent platforms;

providing an inclined ramp on the seaward side of each platform with the maximum height of the inclined ramp abutting the cylindrical hollow core riser at an angle in the range of 110–130 degrees and at essentially the height of the still water level at low tide;

reflecting incoming low tide wave crests steepened by the ramp laterally from the face of the cylindrical hollow core riser and toward the sloping surface of the ramp to thereby produce a much flatter water surface on the landward side of the breakwater assembly.

18. The method of claim 17 wherein wave energy dissipation by the breakwater assembly at mid tides is accomplished by breaking up incoming wave crests by reflecting the wave crests contacting the cylindrical hollow core riser sections laterally and back in a seaward direction to thereby produce a flatter water surface on the landward side of the breakwater.

19. The method of claim 17 wherein wave energy dissipation by the breakwater assembly at moderately high tides by trapping a portion of any incoming wave crest in the hollow core of the cylindrical hollow riser to thereby reduce the height of waves that cross the cylindrical hollow core breakwater and cause a flatter water surface on the landward side of the breakwater; and including the step of providing at least one through opening in the cylindrical hollow riser to permit exiting of any water trapped therein to exit at low water tide conditions.

20. The method of claim 17 including the steps of selectively adding reinforced concrete wafers to the individual hollow core riser to increase the module weight and to enhance the individual module stability, and of selectively removing concrete wafers for ease of reorienting, realigning or removing modules.

* * * * *